US006000522A

United States Patent [19]

Johnson

[11] Patent Number: 6,000,522

[45] Date of Patent: Dec. 14, 1999

[54] MULTI-COMPARTMENT AND ACCEPTORS COMPUTERIZED VENDING MACHINE

[75] Inventor: Alice A Johnson, 8820 Belford Ave., Los Angeles, Calif. 90045

[73] Assignee: Alice A Johnson, Los Angeles, Calif.

[21] Appl. No.: 08/881,021

[22] Filed: Jun. 23, 1997

Related U.S. Application Data

[63] Continuation-in-part of application No. 08/497,997, Jun. 12, 1995, abandoned.

[51] Int. Cl.[6] ..... G07F 11/58

[52] U.S. Cl. ..... 194/217; 221/76

[58] Field of Search ..... 194/217; 221/76, 221/77, 82, 83, 84, 281; 364/479.02, 479.06

[56] References Cited

U.S. PATENT DOCUMENTS

| | | | |
|---|---|---|---|
| 3,253,736 | 5/1966 | Moyer et al. | 221/84 |
| 4,369,442 | 1/1983 | Werth et al. | 194/217 X |
| 4,883,158 | 11/1989 | Kobayashi et al. | 194/217 |
| 5,285,926 | 2/1994 | Falk et al. | 221/76 X |
| 5,438,523 | 8/1995 | Humm et al. | 221/83 X |
| 5,511,646 | 4/1996 | Maldanis et al. | 194/217 |
| 5,533,645 | 7/1996 | Wittern et al. | 221/76 |

*Primary Examiner*—F. J. Bartuska

[57] ABSTRACT

Present invention is a coin operable computer, having compiler memory compiled in both soft and hardware programs, with all supporting elements, an interfaced handshaking memory storage unit and modem card, arranged to run a sequential logic order of operations, in selectively dispensing a variety of products, from a coin operable vending machine after currency protocols have been satisfied, fetch data transactions, store to memory, and when called by a personal computer, transmit the stored data to owners personal computers or other peripheral operated devices, the present computer controlled vending machine provides owners a means of utilizing the art of computer science and modem technology to enhance monetary controls, and enhance profits, while providing consumers a variety of options in purchasing a product utilizing vending machines, as present computerized vending machine incorporates a multiple network of coin accepting units and a plurality of change back return paths, deleting the problem of one coin in and change back unit dictating to the industry, further deletes unnecessary trips to locations, utilizing modem incorporated technology.

8 Claims, 13 Drawing Sheets

MULTI-COMPARTMENT AND ACCEPTORS COMPUTERIZED VENDING MACHINE

This application is a continuation-in-part of Ser. No. 08/497,997 filed Jun. 12, 1995, now abandoned.

BACKGROUND OF THE INVENTION

Field of the Invention

This invention relates to a coin operated vending apparatus for the cutting edge of our century in art of Computer Science. The present invention utilizes programmed computer chips, (hereafter CPU), micro processors, micro controllers, memory storage, their supporting components, and a handshaking incorporated modem. The CPU controlling system is structured designed and arranged in both soft and hardware functional operations, whereby it will store and selectively dispense a variety of products after appropriate amount of currency has been deposited in any one of its multi-coin is accepting devices that interfaces the CPU's programs of sequential logic operations, additionally the present invention will record and store all transaction data into its memory chips, for the interfaced, handshaking modem to access, retrieve and transmit, thus allowing present invention to interact with personal computers.

The computer art and modem technology in present inventions structured design adds a phenomenal convenience to owners and operators primarily in the vending industry, more particular to services, in combination with coin operated apparatuses structure, whereas present invention overcomes several disadvantages presently existing in vending machines commonly used in the marketplace today for dispensing food and non-food products. The present invention was originally conceived and designed with bread and bakery products in mind, however, it should be understood that the vending machine structure disclosed herein can be utilized in other allied fields, such as other foods and non-food products and the likes.

Heretofore vending machines used in the field of dispensing food products have been relatively expensive in the areas of manufacturing cost, servicing, and maintenance. Vending machines heretofore utilized for dispensing products have been relatively complicated by their heavy reliance on one coin controlling device and change unit, mechanical structure, and bulky mechanism, making them complex in structure, and causing complications in many areas of the machine, rendering it incapable of delivering a product, and serving its intended purpose, thereby causing aggravation to the user firstly, as a result of not obtaining a product which was desired, secondly there are no options for purchasing a product once the one coin in acceptor, and change unit dictating operations experiences a malfunction, when that one coin in acceptor, or change unit experiences a malfunction, the machine is shut down, the third grievance of prior art is to owners, when quarterly statements print out and his assets become liabilities when this condition occurs. Still another major disadvantage factor of prior art is the servicing and loading trips, the locations have to be physically visited to check out the status of the machine, even the latest technology of the computerized hand held interrogator, demands a service representative be on location to retrieve data from the machine, and transmit or download it at a later time. Owners at present have no way of long distance communications with their equipment, many times trips are made to locations as a routine check, to find that the machine is not in need of products or servicing, these physical trips consume many manpower hours, wear and tear on private and company vehicles, representing additional aggravation in areas of travel expenses and labor costs in manpower hours, for no sales, equals bank empty, however, gas for travel, and the employees have to be paid regardless.

SUMMARY OF PRESENT INVENTION

Therefore it is a primary feature and advantage to the vending industry to have introduction to the present invention of the upgraded programmed CPU in soft and hardware functional design, handshaking memory storage and modem technology, that interacts with personal computers.

Present invention provides owners of coin operated machines means of communicating with their equipment, having memory storage and modem technology interfacing this CPU controlling system, and gives consumers additional conveniences in obtaining products, utilizing the network of CPU interfaced, handshaking multi-coin in accepting units, and coin catch, hold, sort, divert, stack, and change return devices incorporated in present inventions operating configuration and system design. The present invention allows vending machines to maintain pace with our allies in the rapidly growing era of computer art and modem technology, while overcoming several disadvantages noted in prior art vending apparatuses, in areas of quality control, ease in operations, increase in revenues, and comfort without changing regard to prior art vending machines and similar predecessor structures, whereby vending machines retain advantages attributed them, given consideration in areas of maintenance, cost efficiency, and manufacturing.

The present CPU controlling coin operated vending machine is state of the art equipment for the vending industry, and provides additional conveniences in revenue areas. Investigations, studied statistics and other collected research data indicated, that annual service trips, hourly wages, gas, vehicle expenses, tolls in some areas, lost products, and technicians fees calculated three times the cost in Dollars and Cents than a telephone line annual fee, and a Computer, the only equipment needed for this upgraded convenience. In addition when compared to the latest technology utilized in vending of a computerized interrogator" it was no match, the interrogator did not delete physical trip to location to retrieve data firstly, and secondly an employee has to operate it at the location, so hourly wages were still present, vehicle wear and tear was not deleted, and if the machine is experiencing a malfunction, another trip made be necessary to pick up a part. The present invention of CPU, memory and modem design, allows an owner this knowledge before his trucks roll out of the warehouse, what locations need services, which ones don't, what products to take, and if a malfunction exists, having this information and data at an owners convenience represents an annual savings of 40 to 50 percent. The present invention is CPU programmed in sequential logic performances, as prior art, accept coins, select product, deliver product, cancel credit, deliver change if applicable, go to stand by mode, however, present invention incorporates upgrades providing transaction data storage, and interfaced handshaking modem retrieval, by utilizing a personal computer having its modem. The CPU system incorporated in present invention is programmed in software, for sharing with other computers and hardware for work, functional order of operations in present invention, the CPU controls, from first coin in activation of its CPU program, to last coin out change back unit, and modem retrieval.

FIGURE DRAWINGS EXPLANATION

FIG. 1 is perspective view of a coin operable soft and hardware programmed computer (CPU) system having interfaced modem and memory storage devices arranged and mounted on a motherboard, controlling a vending machine, having private housing distinguishable marked CPU, located in upper front top housing of present invention, thereof, CPU is the controlling factor of all functional operations incorporated in present invention that stores, and selectively dispenses food and non-food products after programed protocols verify appropriate currency has been deposited in any CPU interfaced, handshaking multi-coin in accepting devices, located front doors of present invention thereof.

FIG. 2 is an enlarged front door fragment showing those portions of present invention that houses the CPU interfaced, handshaking coin in acceptors, that align each individual transparent door members compartment, their coin insertion slot, the mating data lines connector, path means to CPU for exchanging data, and the coin in acceptors, coin carrying tracks that direct coins to the catch sort and change unit, discussed in FIG. 5. A first coin deposited in any coin in accepting unit, generates an output activate signal, inputting a start means to CPU programs of operations, the network of coin acceptors are located in plurality of front doors housing, aligned with each individual front door members doors, of present invention thereof.

FIG. 3 is viewing one of plurality structured VDC step motor controlled upright rotating race track formed reel wheel having suspended thereon, a plurality front opened box form "swing type objects" that serve as present inventions product holding shelves, that products orbit around in for viewing, and selecting. Movements of "swing type objects shelves are controlled by a VDC step motor at precise rps to insure proper sync for positioning a product in one individual transparent door member compartments, discussed in FIG. 4, along with connecting solenoid locking set of bridge bars, on swing type the completed preferred embodiment. Each of present invention front door shelters a VDC step motor controlled structured race track formed reel wheel, and its plurality of solenoid locking bridged bars swing type object product holding shelves, located in mid section of present invention housing, thereof.

FIG. 4 is viewing one of plurality center front doors opened, illustrating FIG. 3, a completed preferred embodiment, showing now the solenoid locking bridged bars that are affixed to plurality swing type objects housing, to enclose, maintain packaging quality, and hold products in place as they orbit around, in the swing type objects shelves, connected and suspended therefrom the race track formed reel wheel for viewing and selecting, FIGS. 3, and 4, VDC step motor controlled race track formed structure reel wheel, having connected and suspended therefrom solenoid locking bridged bars swing type objects are located in mid section of present invention housing, thereof.

FIG. 5 CPU systems interfaced, handshaking coin catch, hold, sort, divert, stack and change unit, illustrating segmentation for managing each row of coins in units, deposited coins, also end of FIG. 2, coin carrying tracks, showing path means of coins entering change units segments, further seen are change back, exit paths leading from stacks to front change return plates, located in front lower portion of present invention, housing, thereof.

DETAILED DESCRIPTION AND SPECIFICATION OF THE INVENTION

Figure 1:
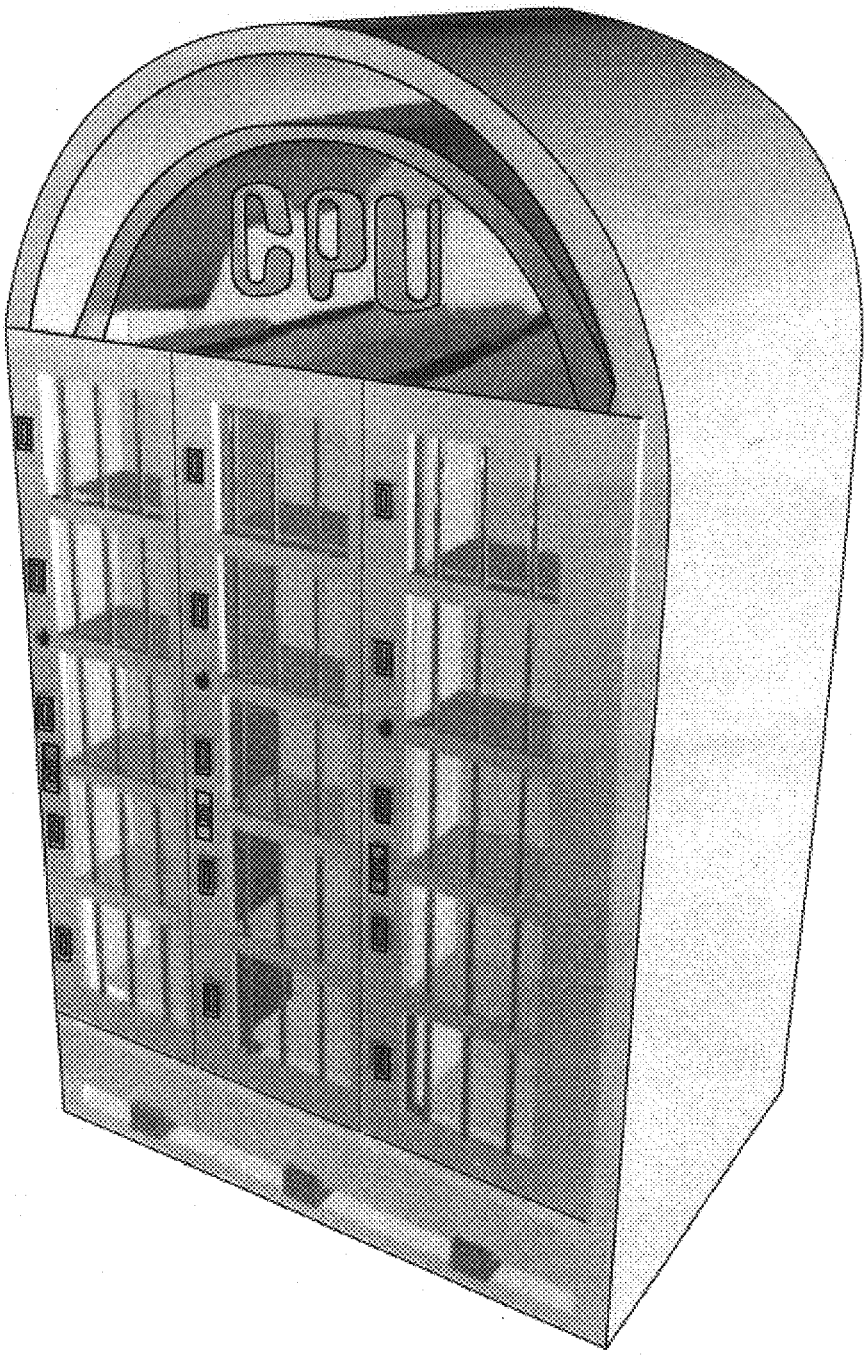
Figure 2:
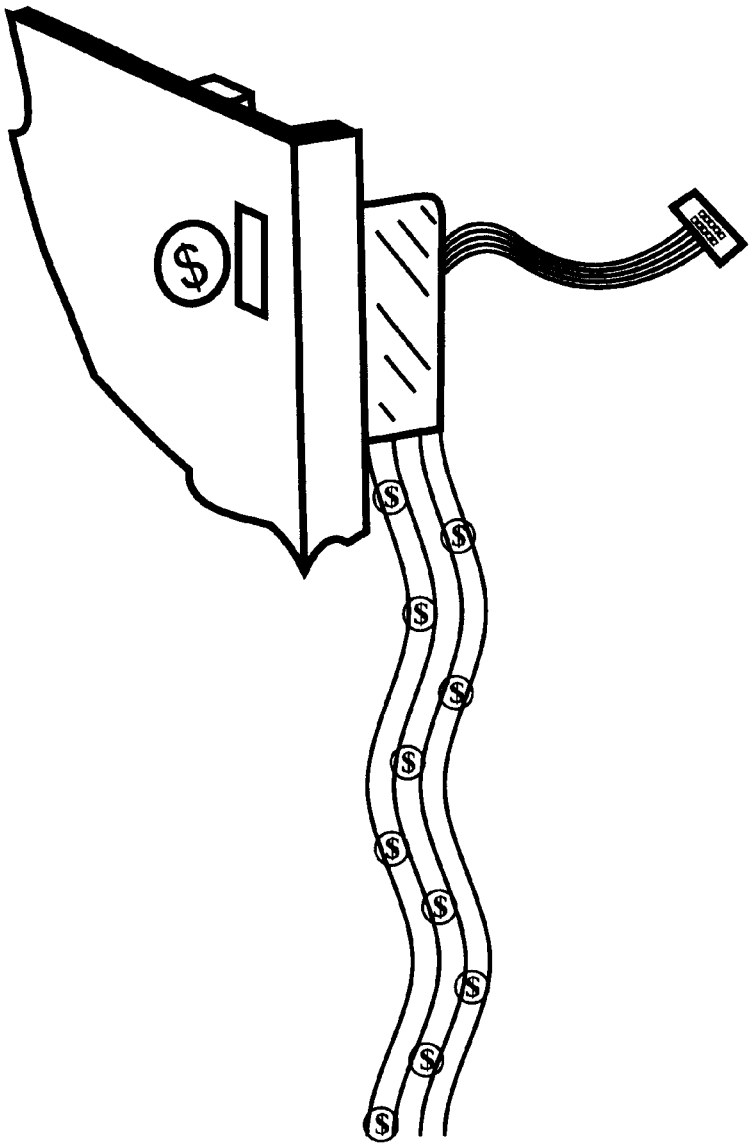
Figure 3:
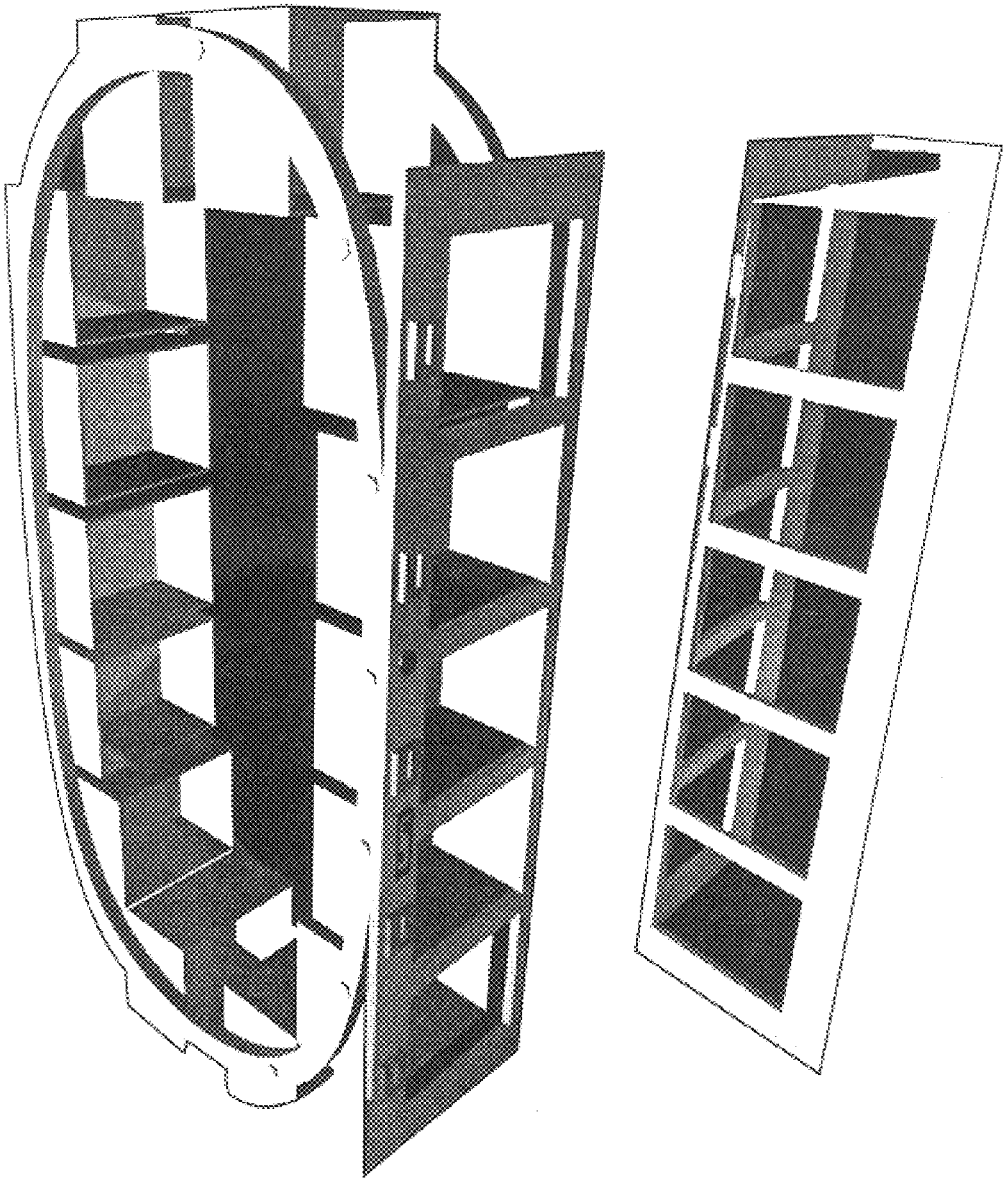
Figure 4:
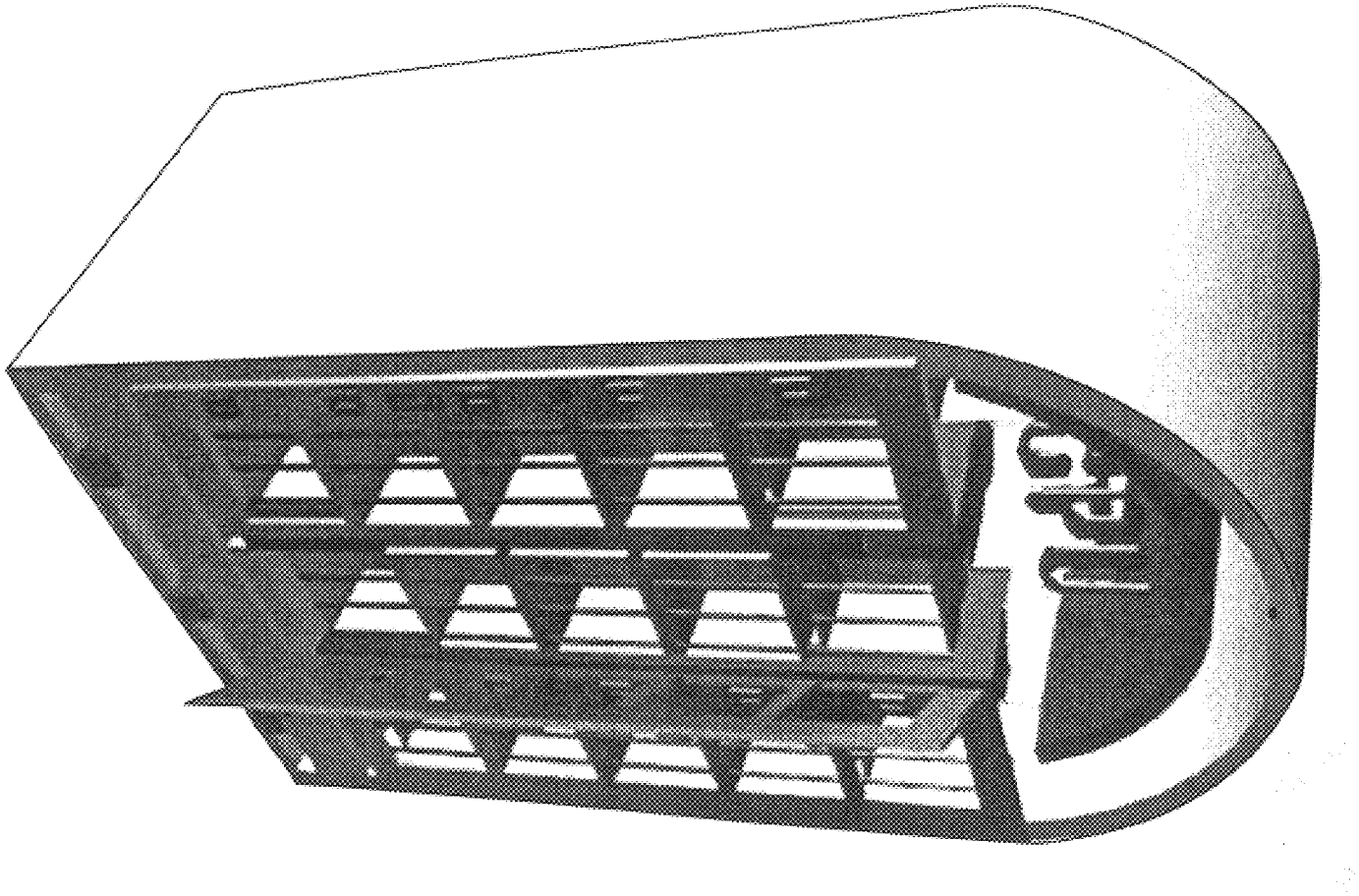

Referring now to FIGS. 6, 1, 2, 3, and 5 seen is a "COMPUTER" (hereafter CPU) having a COMPILER memory to convert and translate a vending machine's functional sequential operations written in a higher level language by a programmer, to a corresponding sequence of machine language instructions on order of operations, whereby performance and desired functional operations will be executed, compiled in logic arrangement and design to form a coin operable, CPU system controlled vending apparatus for selectively dispensing food and non food products, and whereby further having an interfaced, handshaking MODEM, allows the computerized vending machine to be interactive with PERSONAL COMPUTERS, constructed in accordance to principles of this invention and designated generally by the reference numeral (16), the coin operable controlling CPU (16) system is mounted on a motherboard, and has a private housing distinguishable marked CPU in upper top portion of present invention, having a reference designated numeral of (1), of present invention housing (2), whereby a horizontal divider, serves as floor, with a set of hinges placed horizontally at each front edge of said floor connecting door (21), to CPU private housing, whereby having a button fort lock (22), located in center top edge of said private housing (8), having adapted means to sustain, attachment to housing (2), thus said button ford lock providing means of securing said CPU private housing (8), to present invention housing (2), CPU housing (8) further includes lower right corner a digital message screen, (26), notifying consumers present invention (1) options, in embodiment CPU (8) housing, inner dividing floor, door (21) hinge members, nor message center (26) is not herein particularly illustrated or described but it will be understood, that both in combination will be of any suitable configuration to serve intended purpose for CPU operating system (16), housing, within present invention, located in upper top portion of present invention (1) housing (2) thereof The computerized vending machine (hereafter CPU controlled) (1) includes a housing (2) formed of a pair of spaced apart substantially parallel and of uniform length side walls (3) and (4) joined together by a top wall (5) a back wall (6), and bottom wall (7). A plurality of front doors (9) held there on said housing (1), by a plurality of vertically disposed hinges affixed, aligning inner right side edges of each front door, (9), provisional means of securing said front doors to housing (1), and whereby having left side of each front doors (9) secured and held there on by a plurality of incorporate pop up T-lock (10), located on each said front door (9), having a normal locked condition, however by inserting a key into either pop-up-T lock (10) will allow access to inner housing of present invention (1), for servicing of inner incorporated devices, and product holding shelves, the bridged bars (14) swing type objects (13), or their structured race track formed reel wheels, (15), that have VDC step motors incorporated on their structure, that control their rotating movements.

Each front door (9) further include a network of CPU (16) interfaced handshaking coin accepting units (11) aligning front doors (9) transparent door members compartments left side. The transparent compartment doors (12), have located on inner right side, holding them secured to said doors (9) frame a set of vertical placed, spring return switch hinges, preferably aligning inner right side edges, thus self closure means of doors (12) to said front doors (9) frame housing, "left" side of doors members (12) are held to front doors (9), by a solenoid device in design with plunger, located left center inner side of door (9) frame, whereas in deenergized condition plunger is male portion Housing (1) further incorporates a plurality VDC step motors that control the plurality structured upright rotating race track form reel wheels (15), housing connected to and suspended therefrom, a plurality of solenoid locking bridged bars (14) swing type object (13) product holding shelves.

The set of locking bridged bars (14) have a frame door housing holding them securely attached to the swing type objects (13), preferable inner right side by a set of micro hinges, whereby one side of the hinges are connected to the inner door frame and having the other side connected to inner right side of swing type object (13) housing thus means of holding said set of locking bridged bars (14) to said swing type objects (13), and having affixed on swing type objects (13), left side center inner edge a micro solenoid type device having a plunger, whereby the plunger is the male portion of a lock in its deenergized condition, that fits into a female mating hollow structure, conveniently located in preferable, left side inner housing of said set of locking bridge bars (14) frame door housing, thus provisional means of holding the bridged bars (14), across the swing type objects, (13) product holding shelves and providing a locked condition to insure product quality, until energized by the controlling CPU (16) sequential order of operations signal, of release, that allows opening and product removed.

The frame door structure that houses solenoid locking bridged bars (14), incorporates a set of parallel micro tracks, running horizontal, and in uniform length, inside top and bottom portion of frame door structure, and frame door structures left side incorporating the female mating hollow part device providing lock means is designed detachable connected to said frame doors structures top and bottom housing, whereas the said left side of frame incorporating female hollow part is fitting in between grooves of said parallel micro tracks, along with solenoid locking bridged bars, (14), so as to move in a sliding back and forth horizontal motion staying in alignment, utilizing the said parallel micro tracks, inside their grooves.

Whereby having additionally connected to said left side frame door with incorporated female hollow mating lock part, are a plurality of cross over connected micro linked flat bars, having adapted means to sustain, attachment to left side portion of frame housing, door, and additionally connect and provide stability linkage to each of the bars top and bottom along with the incorporated left side frame housing door, now all fitted in between the micro tracks, inside grooves, and affixed so as all to have motion together, thus establishing means of linking and holding said set of locking bridged bars (14) to left side frame housing and fitted inside the frame housing doors.

The micro flat cross over connected bars are designed in uniform length, small but sturdy and connected at their crossed over and angle points, in such an arrangement, for flexibility and moving ability, whereby having a slight pressure applied to frame housing left side causes micro flat cross over connected bars to fold inwardly, thereby drawing horizontally closer together said left side detachable connected frame housing linked to locking bridged bars (14), in a sliding fashion inside said parallel micro track grooves, maintaining alignment, to preferable the right side of said frame structure door housing, thus provisional means of opening said locking bridged bars doors (14) allowing access to said swing type objects shelves (13), for removal of product, when hand pressure is released, said micro flat bars, unfold outwardly, returning to their natural position, thus closing solenoid locking bridged bars doors (14) back to swing type object (13) housing. The solenoid type device serves as locking device means for both doors (12) and (14), the solenoid type device is designed with an electromagnet with a moveable micro core (plunger), used to translate electrical energy into linear mechanical motion. The wire coil is wound on a cylindrical or rectangular tube, and the similarly shaped plunger (which may be either solid or laminated steel) extends about half way into the tube in its "deenergized" state.

When the coil is energized (as an executed CPU signal) by "Direct Current", the plunger is drawn into the tube by magnetic attraction, and the external mechanism connected to the plunger is activated accordingly. Thus allowing the solenoid to be utilized as a locking device, having plunger as male portion, and aligning it to a female hollow design, readily constructed to receive VDC signals, and perform release mechanical function.

Present invention (1) is manufactured and set on location, CPU (16) systems motherboard can be inserted at manufacture, or inserted and plugged into mating connectors at location, which are numbered and color coded for easy assembly the unit housing (1), and modem is plugged into any USA standard 115 VAC outlet, along with the telephone line.

The present invention (1) is now ready to load with product choice, whereby a key inserted into pop-up-T locks (10) provided on housing (1), doors (9) allows entrance to the VDC step motor controlled race track formed reel wheels (15), that house connected thereto, and suspended therefrom, a plurality of solenoid locking bridged bars (14) swing type object shelves (13), that store products until selectively dispensed.

Figure 12:
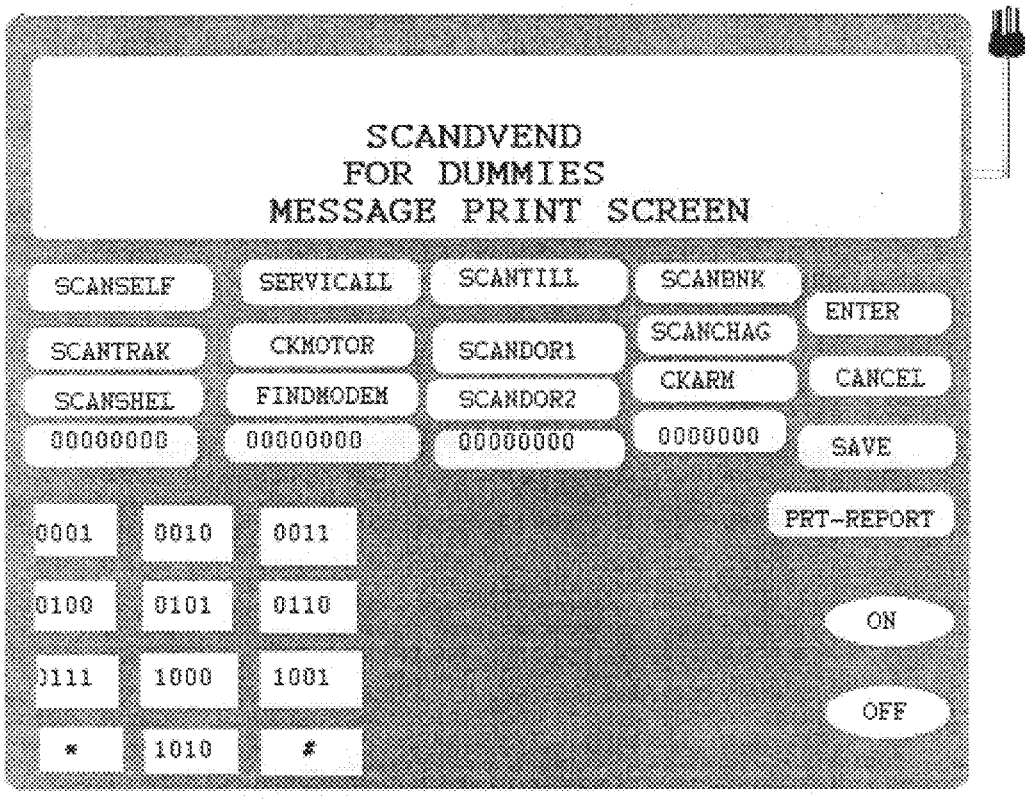
FIG. 12 is a micro peripheral computerized scanvend pad, manually operable, CPU interfaced, with digital message print screen for service, and maintenance calls to locations of equipment for self scan test, error message, and placing machine in service mode for loading products.
Figure 13:
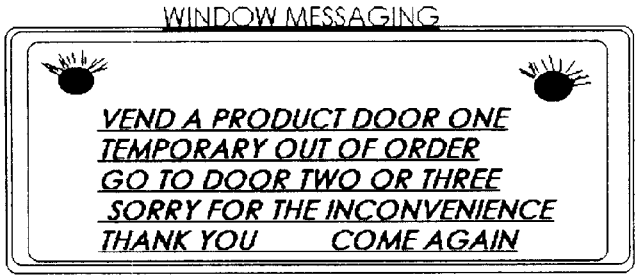
FIG. 13 is a digital message screen, that advises consumers of errors in coin deposits, and options employed in present invention, as no other machines offers multiple coins in and change back units.

The present invention (1) has adapted means to sustain a service, and self scan maintenance mode for loading products, checking internal functional devices, and subassembly subroutine operations, a service personnel can access, and activate this function in two ways, one he can insert a key in CPU housing (8), lock (22) provided in center of symbolic logic alphabets CPU, where located on mother board is a switching circuit means, having a plurality of micro controlling switches, for service personnel to manually operate said switches and derive optional functions incorporated within present invention housing (1) incorporated for price setting and changing, setting the machine in service mode, scanning internal functions as procedure of maintenance check up whereby pressing various switches, signals various scan modes, utilizing programmed codes, or The service personnel can elect to use FIG. 12, scanvend (23) a provided, accessory for present invention (1), scanvend (23) is located preferably inner housing of first front door (9) left hand side wall (3) in present invention housing (1) mid section, scanvend (23) is a manual operated, touch activate binary peripheral key pad, designed with a digital message screen, sized to employ a space size of 3.0×5.8 in, and 1.0 in width, and is a subassembly, subroutine detachable mating plug in unit that interfaces CPU (16) operational system, having a peripheral key control note pad allowing service personnel to punch in binary codes to CPU (16) programs, whereby receipt of binary codes CPU (16) will execute signal command for various service scan modes of operations.

Scanvend provides conveniences such as releasing solenoid locking bridged bars (14) for loading products, re-setting a vend mode, checking internal functions, and other data processing controls, scanvend (23) is provided in present invention (1) to enhance ease, and convenience in maintenance, activating a service mode allows servicing of solenoid locking bridged bars (14) and swing type objects shelves (13) manually to load present invention, (1) with products for distribution on location.

With all swing type objects (13), filled with products, the service personnel enters a code using scanvend key pad, to CPU (16) system of operations and the system will cancel the service mode run a self scan test, and display a reply on scanvends message display screen of an error if one is present, along with an advisory solution or displayed a "vend operation okay" as seen in FIG. 12, when scanvend (23), message reading is "vend operation okay" service personnel, knows CPU operating system has reset machine, and present invention (1) is now ready to dispense products.

Service personnel will close each front doors (9) having the incorporated, individual transparent compartment door members, (12), by turning pop-up-T lock, (10), with key inserted, and pressing pop-up-T lock downward, back into its housing, returning it to its natural position, service personnel will then remove the key, from lock and present CPU controlled, coin operable vending apparatus is now ready to accept a coin, select a product, cancel a credit, deliver product and change if applicable, terminate the vend mode to a stand by position, and after dispense/vend termination.

The CPU (16) order of operation programs will execute a command signal pulsing the memory storage fetch cycle, whereas transaction data will be retrieved in binary, and stored to memory until called by a "personal computer" utilizing modem technology interfaced, and handshaking the present invention (1) CPU (16) operational system, thus means of owners communicating with their equipment on locations, accessing pertinent bookkeeping data giving them more monetary control, without physically visiting a location.

A consumer either by impulse, or need steps up to present invention (1), and wants to review its contents, located on each front door (9) under the second coin in accepting unit (11) of each front door (9) is an index button (17), the consumers controls to the VDC step motors controls for each race track formed reel wheel (15) movements, housing, connected to and suspended therefrom a plurality set of solenoid locking bridge bars (14), swing type objects (13), product holding shelves for a consumers selection and purchase, the VDC step motor controlled said race track formed reel wheels are located, inner mid section, of each front door (9).

The VDC step motor are designed having micro Molex plug in connectors for each race track formed reel wheel (15), that interfaces CPU (16) programs of operations, means of receiving signaling commands directing movements and positioning, from said CPU (16), whereby suppressing index button (17), activates an input, notifying, CPU (16) operational system, request for product view is present, the CPU (16), upon receipt of the notification, executes a command signal, thus the start means of VDC step motor unit driving race track formed reel wheel (15), having connected to, and suspended therefrom, the set of solenoid locking bridge bars (14), swing type objects (13), shelves loaded with products riding around said race track formed reel wheels (15), orbiting products for consumer to view, in precise digital predetermined steps, releasing said index button (17), causes the motor to stop motion thus stopping the said race track formed reel wheels (17), and products suspended therefrom in the connected, and suspended swing type objects (13) shelves.

The VDC step motor are designed in precise Revolutions Per Seconds (hereafter rps) high torque, having adapted means to sustain work load, while staying in sync with it pre calculated digital movements, insuring, quality in product packaging, delivered to consumers.

The pre-determined movements of said VDC step motors are tailored to the individual swing type object (13) shelves, insuring, whenever index button (17) is released, a swing type object (13) holding a product will stop aligned, and positioned in one of plurality individual transparent compartments doors (12), after selection of desired purchase is positioned in said transparent compartment (12) door, the consumer would deposit ample coins in CPU (16), interfaced handshaking coin in accepting unit (11), having an insertion slot (18), located on front doors (9), aligning individual transparent compartment door (12), where selection is positioned.

The "consumers first deposited coin" in the coin accepting unit, (11), housing is start means of CPU (16) operational systems of programs in logic sequential order of operations in present invention (1), whereby said coin in accepting unit, having adapted means of a general purpose microprocessor/clock, gate circuitry, whereby said first coins abrupt entrance, awakens said microprocessor/clock, gate circuitry, creating change in condition, and generating a toggle output signal, that inputs interfaced handshaking CPU (16) operational system of logic operational programs of sequential order of operations, thus said coin operable, output, providing start means to CPU (16) programs, which immediately goes to $1^{st}$ step, of coin operable system of judging and accepting a coin, coin in acceptors (11) are located in front doors (9) of present invention (1) housing, thereof.

CPU operating compiler operational system design compiles an algorithm for each denomination of coins voltage generation calculated, and defined in decimal constants, and said decimal constant value, converted to a binary logic coded constants and compiled in present inventions (1), CPU (16) logic operating system thus giving said CPU (16) logic operating system ability to judge coins authentic value, register and count them, compare the accumulative value to priced product, and upon receipt of protocol satisfaction the CPU (16), executes signals commands to necessary locked conditions, to an unlocked condition, whereby a consumer can obtain a product.

The CPU (16) logic operating system, after first coin start means, is takes the drivers seat and is the controlling element of this computerized vending apparatus.

The coins pass through coin in accepting devices, having adapted circuitry means to direct coins, to one of duo coin carrying tracks (20) connected to the coin in accepting units (11).

The said coin carrying tracks (20) are designed in a curving, slant downward manner, insuring a continued roll to their destination of the interfaced handshaking change unit (19).

One side of coin carrying tracks (20), is provided for present inventions, (1), house coins, and the other is for returns, whereby the change units housing (19) having adapted means to sustain, directing the return to connecting plurality change back plates (25), which are additionally designed in a slant downward position that find their end in the lower front portion of present invention housing, return and change back paths plates.

Figure 5:
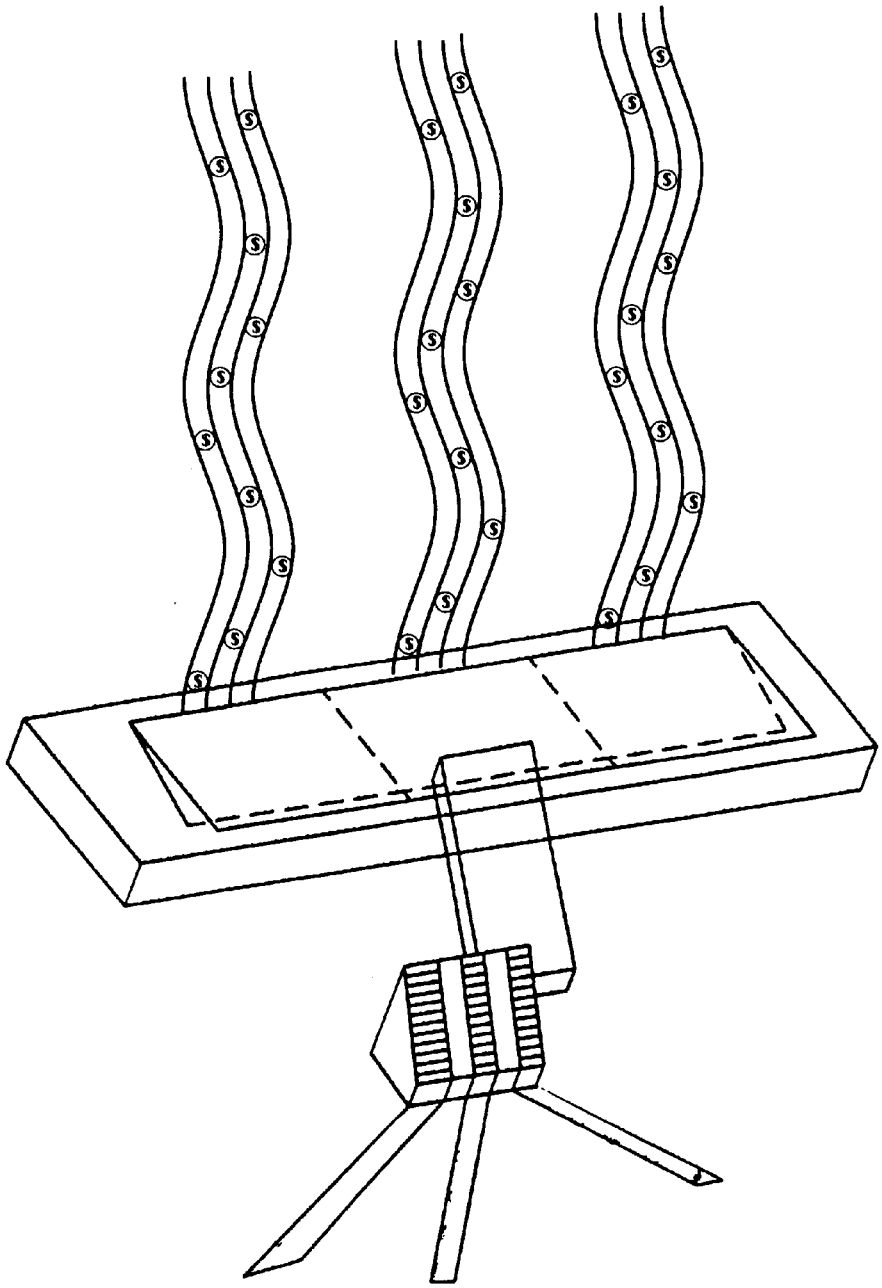
Figure 6:
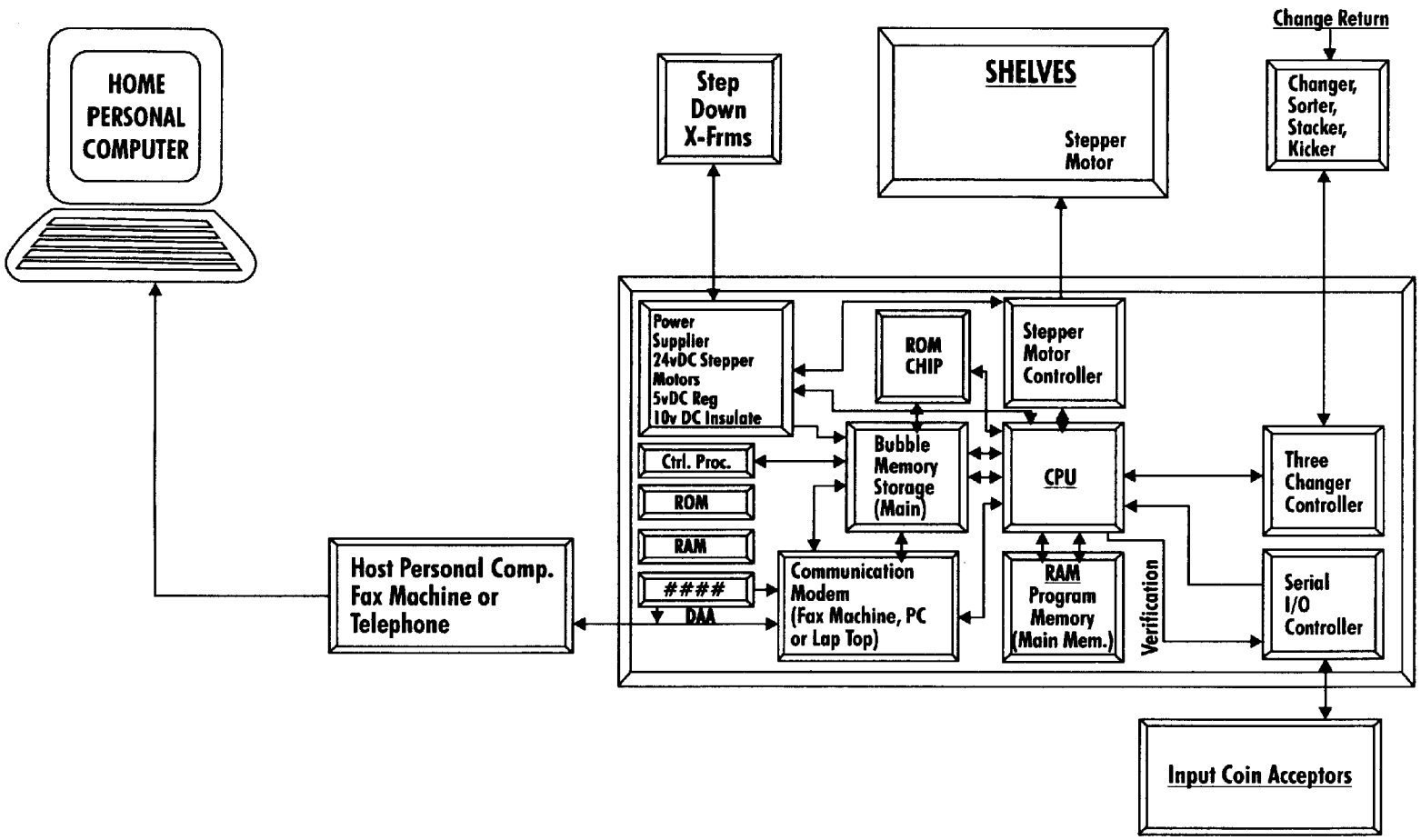
FIG. 6 is a diagram of a computer programmed to be the controlling element of a coin operable vending machine, and allow its memory storage device unit to be accessible by a personal computer utilizing its interfaced, handshaking modem.
Figure 7:
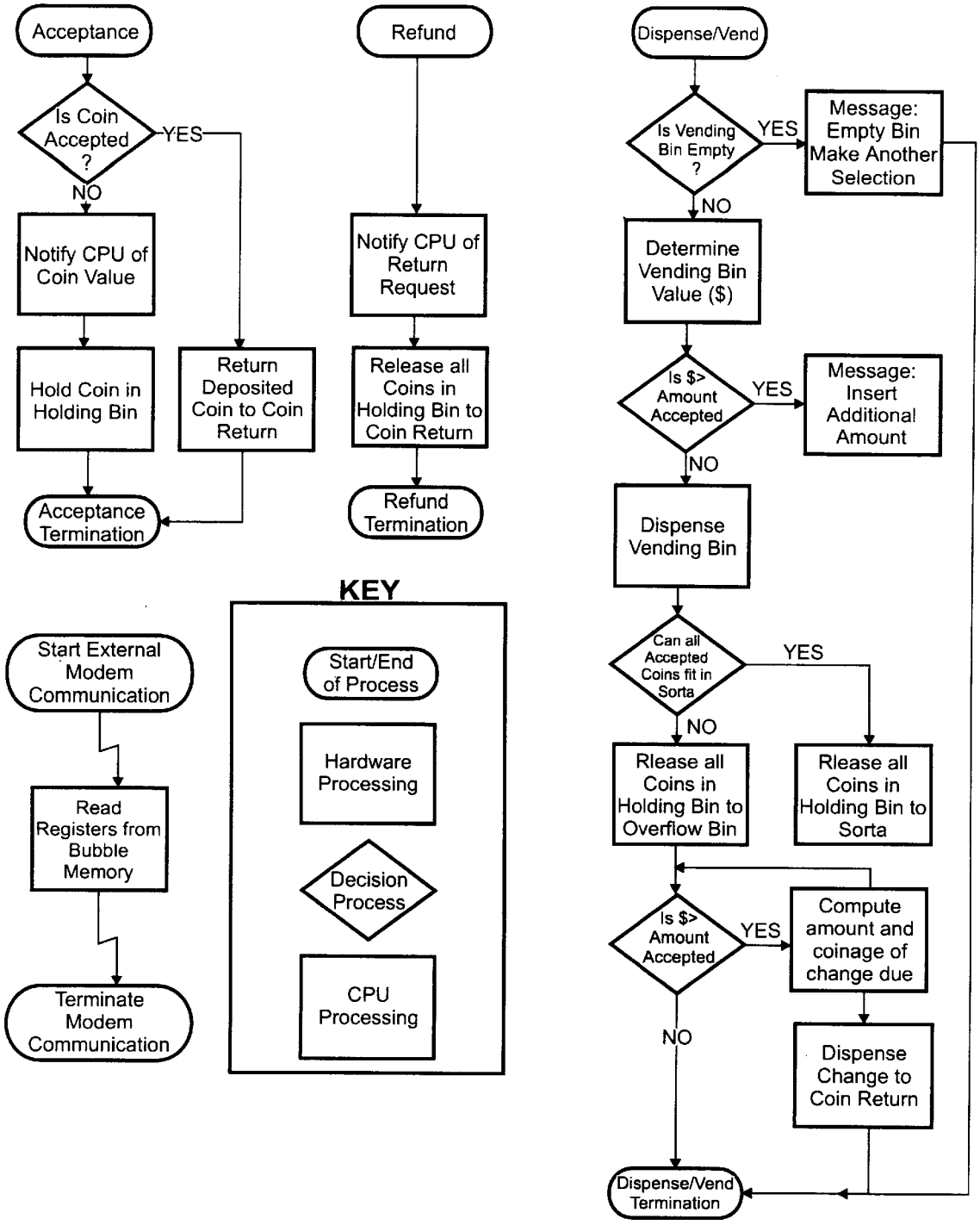
FIG. 7 is a symbolic diagram representation of the programmed CPU's logical sequential hardware routine vend functional operations, the modem, and key to the symbolic diagram.
Figure 8:
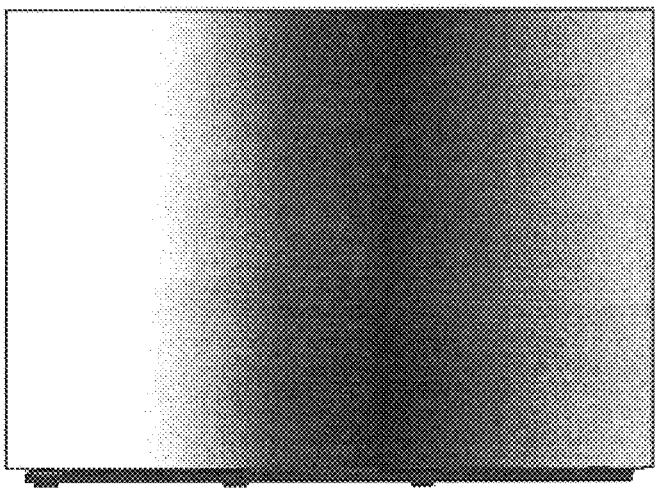
FIG. 8 is the top of present invention housing.
Figure 9:
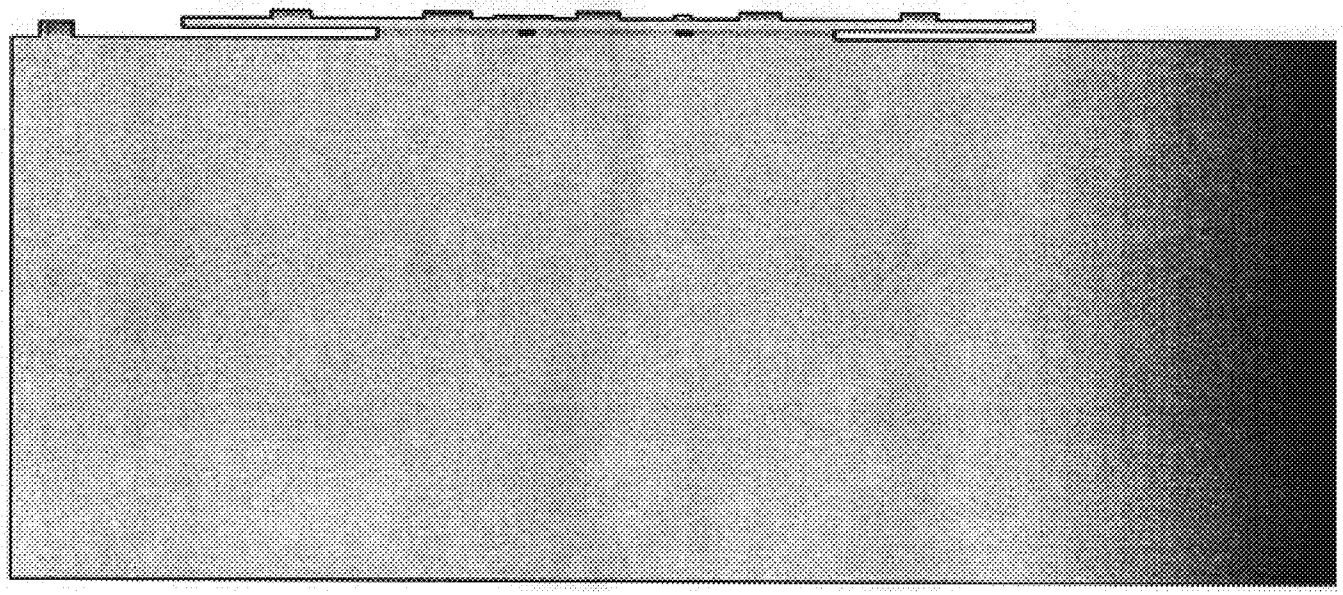
FIG. 9 is the side of present invention housing.
Figure 10:
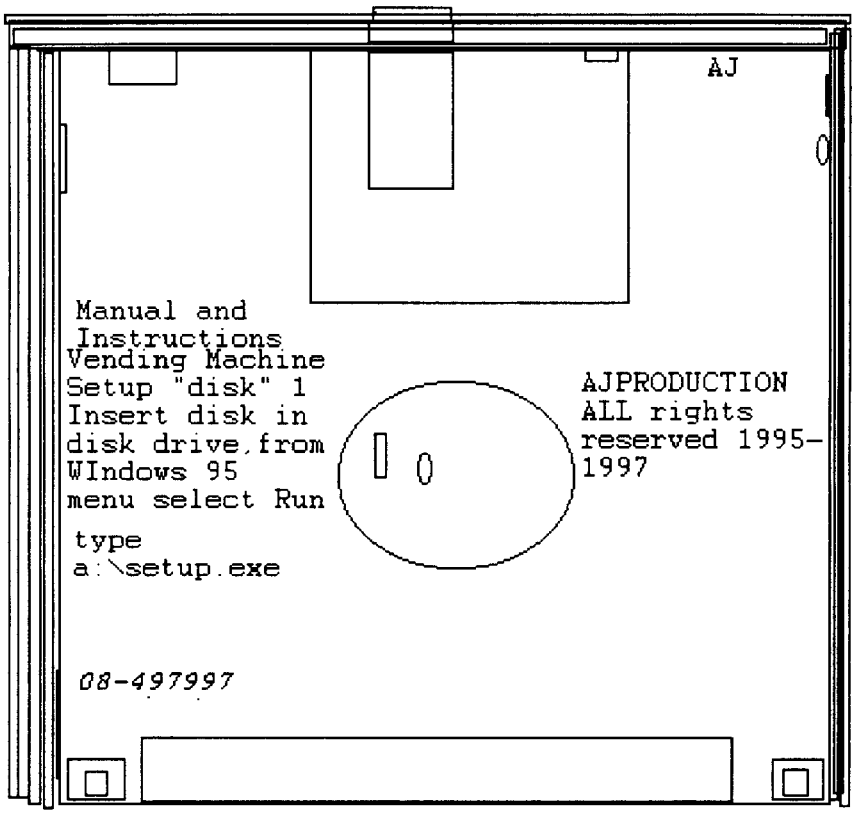
FIG. 10 is a set of 3.5 floppy diskettes, illustrating distribution style of manual instructions, in a format program compatible to run on most computers, whereby loading programs owners will have easy instructions on all tips and help for calling equipment, and copying data for bookkeeping, for aggressive owners and the computer dummies.
Figure 11:
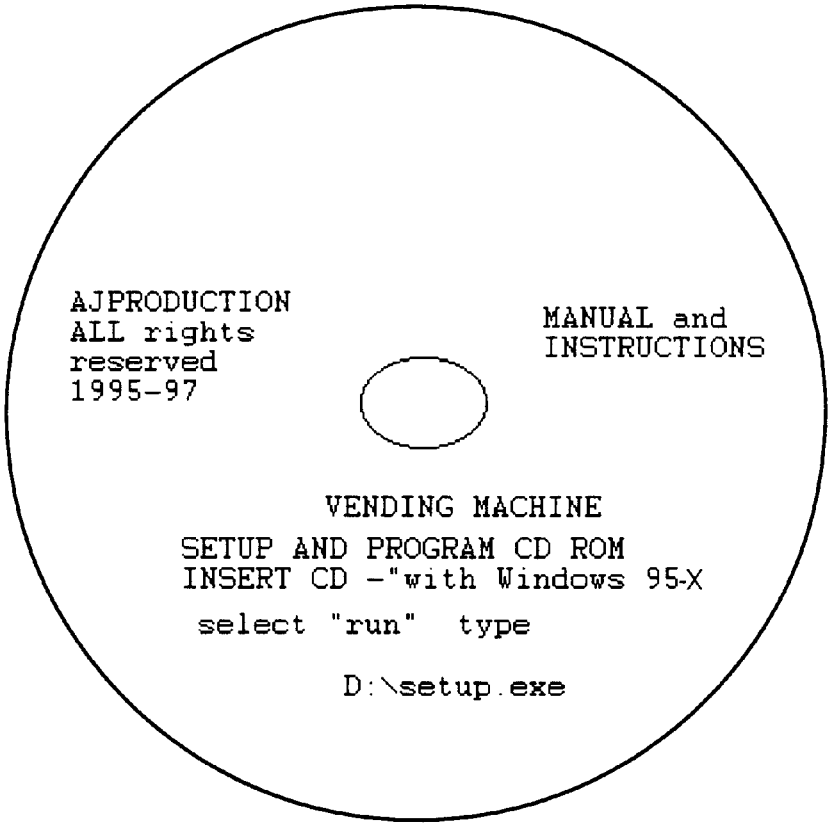
FIG. 11 is same version, FIG. 10, different style, illustrating a CD-ROM, for present CPU invention FIG. 1.

CPU executes a signal to FIG. 5, the coin catch hold, sort, divert, and change unit, (19), thus activating its catch hold mode of operations, start means to unit (19) plurality center segments first cycle of its sequential order of operations, the segments are located in the center sections of said change unit (19) housing thereof.

Each segment housed in said change unit (19) is a subassembly subroutine their activation depends on which of present inventions (1), front doors (9) and or row of coin in accepting units (11) are being used.

The change unit (19), is designed aligning the base of plurality front doors (9) conveniently located under the coin in accepting units thereby catching each coin deposits from door (9) and incorporated row of coin in accepting units (11), utilizing coin carrying tracks (20) provided, the change unit (19) incorporates a plurality of individual, independent operating segments, whereas each of said segments employ identical sequential orders in operations, to catch hold, divert, sort, and deliver change back, depending said front door (9) and row of coin in accepting units (11), used, the independent operating segment of subassembly subroutine is activated accordingly.

The plurality of CPU (16) interfaced handshaking individual segments of operations located in the change unit, (19) taken into combination with the multiple CPU coin in acceptors units (11) gives present invention (1) extended means of operations.

The multiple coin in accepting units (11) gives a consumer additional resources of chances to purchase a product, thereby, deleting a problem of industries heavy reliance on, one dictating coin in accepting device and change back unit currently found in the marketplace today.

Each segment of subassembly subroutine program, with "return" statement, will handshake the CPU (16) data exchanging signals, whereas, when cumulative protocols of product priced amount are registered in the holding bin unit of said change unit (19), the CPU (16) is notified, and will executes simultaneous in sync command signals to both the individual transparent compartment doors, (12) and set of locking bridged bars doors (14), enclosing product in swing type objects (13) shelves, thus energizing both, and changing their state from a locked condition to a now opened one, allowing the consumer to grasp the individual transparent compartment (12) door, having adapted molded means to sustain a groove, utilized as a handle, open said individual transparent compartment door (12), push preferable to right side, the left side of frame housing door, of bridged bars (14), and remove product from said swing type object (13) shelf.

Once the product has been removed, and consumers hand pressure is released, the frame structure door housing linked to set of solenoid locking bridged bars (14) by micro cross over connected bars, will assume their normal state automatically, by unfolding, outwardly, extending themselves, thus providing means of closing the locking bridged bars (14) back to the swing type objects housing (13) to a closed condition, and the individual transparent compartment door (12), having adapted means of the spring back switch hinges, will automatically close.

The CPU (16) will execute final logic operations command signals in vend a product operations programs, which cancels the credit, signaling change back unit (19), its applicable segment cycle operation.

The active segment performs its designed program of logic sequential order of operations functional ending, in signals a release all coins to a holding bin, sort, and kick them to their appropriate bin in stack housing.

If the CPU (16) logic operating systems, in order of operational programs detect that the coin bin stacks housings are at their capacitance, said CPU (16) will execute an overflow command, whereby signaling appropriate segments inner divert chute, incorporated in each segment of change unit housing (19), thereby energizing said inner divert chute path, connected therein said segment units located in the center housing of change unit housing (19), thereof.

The segments inner divert chute upon receipt of said energizing signal from the CPU (16) system will change its position, from a normally opened path, to a now closed one, thereby closing the coin path to coins bins stacks, housing (24) to the diverted overflow path, thereby directing coins path to house bank, which is the present inventions housing (1) bottom inner inside wall (7), (the floor) (hereafter referred to as the house BANK).

The BANK, and overflow function was incorporated in the present due to its design having multiple coin in acceptors, the call in utilizing function utilizing the interfaced, handshaking modem, interacting with personal computers, and overall structured design of prevent present invention (1), whereby, an owner, having a non perishable product, such as men shirts in an airport location, etc., may elect to have X$, in the bank before visiting the site, the divert chute would insure that present invention would not experience a common problem, known to industry as a coin in jam, or often referred as a change unit's jackpot.

If the holding bins of stack housing are not at their capacitance, the change unit (19), segments order of normal sequential operations would continue, (reference printed literature on processing coins procedures) accompanying this application)) and release coin bin contents from the catch hold mode cycle of operations, sort, and kick coins to their appropriate bin in coin stack housing unit (24), along with a kick back change to consumer, if applicable, its sequential order of operations, to one of plurality change back paths (25) provided connected at exit end of said coin bins stack housing (24), the return change back paths plates, (25), illustrated, endings are located in front lower portion of present inventions (1), housing thereof.

When a condition of change back is applicable, the CPU (16) operating systems in logic sequential order of operational steps will execute a signal command to, said coin bin stack housing, (24), having connected thereto each bin of said coins stack, an armature type electromagnet device, taking on a shape in design, somewhat as a micro thumb, and said micro thumb having a micro coil winding, and housed in a micro tube, where said tube housing having connected thereto its outer side housing micro lines, with respect to ground, interfacing CPU's (16) logic programs.

Whereby the CPU (16) supporting elements having register capabilities in arithmetical logic, and allowing CPU (16) to access it in order of operations, for its computed, determined amount of change due back to a consumer, depending original deposit and product priced amount received, the CPU (16), operating system will execute command signals in binary pulse code to said armature type electromagnet device having, shape in design of said micro flat thumb, thereby energizing and controlling said flat thumb, utilizing logic binary code 1's and 0's to create a pulse as needed. Whereby said armature thumb, upon receipt of a pulse will move accordingly on said coin bin stack housing, (24).

The CPU (16) operational system utilizes the binary code to count currency, whereby the present or absent of a pulse, represents a currency amounts, and where further the number of times pulsed, represents the number of coins that is needed, that would be released from the coin stack bins, in sync when the micro thumb, pulsed that particular coin stack thus providing means of counting change back to consumer when applicable, by the CPU (16) system of operations from change unit housing (19), the change unit (19) is located in present invention lower front housing (1) thereof.

CPU (16) compiler program of logic sequential order of operations system, after change unit (19) mode of operations has completed will terminate vend a product mode of operations in present invention (1) thus closing programs of operations down, and setting present invention (1) back to a stand by position until another coin is deposited in one of present inventions (1) coin in acceptor units (11), whereby the multi-compartment and acceptors CPU (16) controlled vending machine will repeat its repetitive programs of sequential order of operations.

The CPU (16) compiler order of operations will continue after vend mode, and kick in to a control data function whereas, the vend sale transaction data is fetched in binary code and stored to a bubble memory or the likes device, until the interfaced, handshaking modem accesses the memory location for its store data.

The CPU (16) operational systems interfaced handshaking modem accesses the memory storage and retrieves its data information in logic binary code, the modem performs a modulation in the form of signal conversion, for interfacing computers or computer peripheral equipment to the telephone line, instead of trying to send a binary logic "0" or "1" dc voltage level over phone lines, where voltage transients or noise pulses could be interpreted as false signals at the other end of the lines, and where transformer coupling is used, the modem changes the binary logic "1" and "0" into pulse audio tones.

The tones travel over the phone line and enter a companion modem (in a personal computer) at the other end of the line and are converted back into binary logic "1" and "0" to properly interface and communicate with a computer or computer peripheral equipment. Thus allowing the owners in the vending industry to call in present invention (1), CPU housing (8) and communicate (inquire status of vending apparatus bookkeeping information) from CPU logic operating system (16) without physically visiting a site to obtain it.

This application is a continuation-in-part of Ser. No. 08/497,997 filed Jun. 12, 1995 now abandoned, the present invention consists of plug-in subassembly subroutine units, that meet and plug in their mating male or female connector data lines, thus the provisional means of interfacing, and handshaking the CPU (16) compiler programmed system of logic sequential order of operations, whereby readily to receive and transmit data between the CPU (16) and subassembly subroutine units, desired functions.

The data plug-in harness lines are numbered and color coded for ease, and convenience in matching their appropriate connector, and run around the side's (3), (4), and bottom wall (7), of present invention inner (1) housing, neatly arranged away from functional operations of present invention (1), thus forming a path to the back wall (6), now in position to meet and plug into the mating male or female connectors coming from the CPU (16), back private housing (8), located in the top of present invention housing (1), the new subassembly subroutine plug-in arrangements provides additional ease in maintenance to present invention housing (1), firstly for interfacing and handshaking (16) CPU's system of programmed operations and secondly, ease in disconnecting and replacing a particular unit package in trouble shooting phase of the apparatus. All logic data on the continental U.S.A., market today, has supporting documentation of parts, components, chips, storage, modems, motors, lock devices, fabricated material, microprocessors and the (CPU) chips, needed to manufacture present invention (1), which is a computer (hereafter CPU) compiled in soft and hardware languages, binary codes, an interfacing handshaking modem, and necessary supporting elements to form an operating system, designed as coin operable, which will activate a CPU to control a vending machine, that will store, and selectively dispense a variety of products, when ample coins deposited satisfy the CPU operating system protocols, and further, store the transaction data to its system memory, and whereby utilizing the systems interfaced modems, transmits, said stored transactions data to a personal computer, thus allowing communications with vending machines and computers, utilizing the computer operating system incorporated in present invention Details on the following pages of this specification provide additional descriptions regarding the CPU Soft and Hardware considerations and terms, acceptance process, CPU processing, and a compute change table example.

Hardware Considerations and Terms

Coin Acceptor

Accepts coins by verifying their value and authenticity. Those coins rejected are routed immediately to the coin return. Coins accepted are routed to the Holding Bin pending refund or vending.

Holding Bin

Area in which all coins are collected for a given acceptor. Coins are released upon request for refund or the vending of the product.

Coin Return

Area which un-accepted coins, full refund (canceled selection) and change is returned to the customer.

Sorta/Changer

Unit that sorts coins to be used in preparing change upon overpayment into "tubes" by coin type. Unit also selects the proper number of coins to be dispensed in the process of making change.

Overflow Bin

Container of all coins from purchases which would not "fit" into the Sorta/Changer at the time of sale.

Assumptions

All processing is described as if it were a single unit. The only shared component that needs to maintain which Acceptor/Vending Unit is being processed is the Sorta/

Changer. This is to insure that the change being delivered is "routed" to the appropriate Coin Return.

CPU/Software Considerations and Terms

Accumulators

Counter in memory which counts the number of items. For each coin type being monitored (nickels, dimes, and quarters) there are three unique accumulators For each item being tracked there is one set of three accumulators. Items being tracked would include, but not limited to: Coins in Holding Bin 1, Coins in Holding Bin 2, Coins in Holding Bin 3, Maximum Coins in Sorta/Changer, Minimum Coins in Sorta/Changer, Current Coins in Sorta/Changer, Current Coins in Overflow Bin, etc.

Indicators

Indicators are switches in memory that indicate specific conditions. These switch settings are checked after every transaction is processed through the CPU.

The "No Change" indicator is set if any accumulator in Current Coins in Sorta/Changer is less than the corresponding accumulator in Minimum Coins in Sorta/Changer.

The "Sorta/Changer Full" Indicator is set if any accumulator in Current Coins in Sorta/Changer plus the corresponding accumulator in Coins in Holding Bin (x) is greater than or equal to the corresponding accumulator in Maximum Coins in Sorta/Changer.

The "Value in Holding Bin (x)" contains the computed value of all coins accepted by the corresponding Coin Acceptor.

The "Value of Vending Bin (y)" contains the predetermined value of the product to be dispensed from bin (y). This value is set by the operator, and may not be changed by the customer.

The Acceptance Process

```
If the coin is accepted
then        Notify the CPU as to type of coin (value) and Acceptor Id
            (CPU Process 1)
            Save the coin in a holding bin
else (rejected)
            Route coin to the Coin Return
```

The Refund Process

Notify the CPU that a return was requested (CPU Process 2)

Release all coins in the Holding Bin (for the acceptor) to the Coin Return

Dispense/Vend Process

```
If Vending Bin is Empty,
then        no transaction takes place
            Message to operator, "Empty Bin, Make Another Selection"
            Terminate Dispense/Vend Process
If Vending Bin is Full (default if processing logic passes to this point)
Determine value of Vending Bin (y) Indicator (as each bin can vary
in price)
Determine amount accepted in Holding Bin (x) Indicator
If Vending Bin (y) Indicator is greater than Holding Bin (x) Indicator
then        Message to Operator "Insert Additional Amount"
            Terminate Dispense/Vend Process
Dispense Vending Bin
If "Sorta/Changer Full" Indicator
then        Release all Coins in Holding Bin (x) to Overflow Bin
            notify the CPU that a sale was completed (CPU Process 3)
else        Release all Coins in Holding Bin (x) to Sorta/Changer
            notify the CPU that a sale was completed (CPU Process 4)
If Vending Bin (y) Indicator is less than Holding Bin (x) Indicator
```

-continued

```
[change due]
then        Compute amount and coinage of change due (CPU Process 5)
            Dispense Change to the Coin Return (x)
            Terminate Dispense/Vend Process
else        Terminate Dispense/Vend Process
```

CPU Processing

Process 1—Coin Accepted

Add 1 to Count of coins for the value of the coin accepted (i.e. if the second nickel was entered, the count of nickels would be 2)

Compute the total value of all coins accepted (Add value of coin accepted to acceptors' accumulated value)

Process 2—Refund Requested

Zero all Counts of coins for the specific acceptor

Zero acceptors' accumulated value (total value of all coins accepted is reset to zero)

Process 3—Accepted Coins to the Overflow Bin

By Coin type

Add the number of coins accepted to the number of coins in the coin bin

Compute the Value of coins in the Overflow Bin by multiplying Coin Value times Coin Count Compute the total value of all coins in the Overflow Bin (Sum the value of all coins by coin type)

Process 4—Accepted Coins to the Changer (Sorta)

By Coin type

Add the number of coins accepted to the number of coins in the coin sorta

Compute the Value of coins in the sorta by multiplying Coin Value times Coin Count Compute the total value of all coins in the Sorta (Sum the value of all coins by coin type)

Process 5—Dispense Change

Compute the amount of change to be dispensed by subtracting the value of the product from the amount accepted Use the following table to determine the count of coins, by type, to be returned to the coin return:

| Change | Nickels | Dimes | Quarters |
|---|---|---|---|
| $0.05 | 1 | 0 | 0 |
| $0.10 | 0 | 1 | 0 |
| $0.15 | 1 | 1 | 0 |
| $0.20 | 0 | 2 | 0 |
| $0.25 | 0 | 0 | 1 |
| $0.30 | 1 | 0 | 1 |
| $0.35 | 0 | 1 | 1 |
| $0.40 | 1 | 1 | 1 |
| $0.45 | 0 | 2 | 1 |
| $0.50 | 0 | 0 | 2 |
| $0.55 | 1 | 0 | 2 |
| $0.60 | 0 | 1 | 2 |
| $0.65 | 1 | 1 | 2 |
| $0.70 | 0 | 2 | 2 |
| $0.75 | 0 | 0 | 3 |
| $0.80 | 1 | 0 | 3 |
| $0.85 | 0 | 1 | 3 |
| $0.90 | 1 | 1 | 3 |
| $0.95 | 0 | 2 | 3 |

Having thus described the invention, what is claimed:

1. A computer controlled vending machine system that selectively dispenses food and non food products including:

a housing, a CPU private housing, a private bank housing, a plurality of front door frames with each doorframe including a plurality of individual transparent compartment doors, a central computer which operates the vending machine according to a program of operations and stores data indicative of the performance of the vending machine, a modem that can access the data stored in the computer and transmit the data to a personal computer, a plurality of multiple micro coin acceptor units having flip flop circuitry whereby an insertion of a first coin creates an output toggle pulse to activate the program of operations, and wherein the pluralities of coin acceptor units are located in the front door frames with each coin acceptor unit aligned with a transparent compartment door, and insertion of a predetermined value of coins in one of the coin acceptor units allows the aligned compartment door to be opened allowing dispensing of the product.

2. The computer controlled vending machine of claim 1, including coin carrying tracks leading from coin acceptors, having adaptive means of directing coins into multiple change back units.

3. The computer controlled vending machine of claim 1, including a plurality of change units, and adaptive means to sort and return coins.

4. The computer controlled vending machine of claim 1, including a plurality of race track form reel wheels, and a plurality of swing type objects shelves, connected to each race track form reel wheel providing means of storing products until selectively purchased, and a plurality of inner solenoid locking bridged bar doors, one bridged bar door connected to each swing type objects shelf for securing products while orbiting around in the swing type object shelf, and a plurality of VDC stepper motors connected to the structured race track form reel wheel provides controlling means of wheel orbiting around its structure.

5. The computer controlled vending machine of claim 4, including a plurality of index buttons, whereby, suppressing said index buttons will activate the VDC stepper motors, providing driving power to the race track form reel wheels connected shelves, in precise revolutions per second, release of index button positions shelves in the individual transparent compartment, allowing stored product to be selectively purchased, the index button is located on each plurality front door frames of present invention housing.

6. The computer controlled vending machine of claim 1, including a numerical binary coded keypad peripheral device with a digital display screen, whereby punching in a programmed binary code key, activates optional service modes of operations ability to perform a self test diagnostics, provides ease in loading and servicing etc., machine on location, this keypad peripheral device takes housing on the inner wall, mid section of present invention housing.

7. The computer controlled vending machine of claim 1, including software directive programs on CDROM and or 3.5 floppy diskettes in setup, sample spreadsheets, help tips, and literature written in a basic computer format, compatible to load on any computer.

8. The computer controlled vending machine of claim 1, including an advisory digital print out message screen, alerts users, options and advisory directions on utilizing the present invention, such as coin deposit errors, a particular row of product need servicing, try another row etc., the advisory digital print out screen is located in the lower right hand corner of the CPU private housing, located in top front portion of present invention housing.

* * * * *